United States Patent [19]

Bentele et al.

[11] 4,204,800

[45] May 27, 1980

[54] MULTISTAGE SIDE CHANNEL COMPRESSOR

[75] Inventors: Benedikt Bentele, Bad Neustadt; Gert Hecht, Bremen, both of Fed. Rep. of Germany

[73] Assignee: Siemens Aktiengesellschaft, Berlin and Munich, Fed. Rep. of Germany

[21] Appl. No.: 891,803

[22] Filed: Mar. 30, 1978

[30] Foreign Application Priority Data

May 11, 1977 [DE] Fed. Rep. of Germany ..... 2721233

[51] Int. Cl.[2] ..... F04B 5/00

[52] U.S. Cl. ..... 415/53 T; 415/153 A; 415/198.2; 415/213 T

[58] Field of Search ..... 415/53 T, 59, 127, 148, 415/149, 213 T, 219 R, 219 C, 153 A, 198.2

[56] References Cited

U.S. PATENT DOCUMENTS

| | | | |
|---|---|---|---|
| 2,957,426 | 10/1960 | Miller | 415/149 |
| 3,545,890 | 12/1970 | Hubbard et al. | 415/213 T |
| 3,915,589 | 10/1975 | Linden | 415/153 A |

*Primary Examiner*—Louis J. Casaregola
*Attorney, Agent, or Firm*—Kenyon & Kenyon

[57] ABSTRACT

An improved side channel compressor wherein the compressor comprises first and second compressor stages each including first and second housing halves. In accordance with the invention, the inner housing halves (i.e., the second housing half of the first stage and the adjacently arranged first housing half of the second stage) are each provided with inlet and outlet openings of the same size and shape and with sealing rims surrounding these openings. In further accord with the invention, the second housing half of the first stage is provided with a further sealing rim arranged in the circumferential direction ahead of the outlet opening of that housing half and the first housing half with a further sealing rim arranged in the circumferential direction behind the inlet opening of that housing half. The further sealing rim of the second housing half is further arranged so that the distance between its center and the center of the outlet opening of that housing is equal to the distance between the centers of the rims surrounding the outlet and inlet openings of the housing half. Similarly, the further sealing rim of the first housing half is arranged so the distance between its center and the center of the inlet opening of that housing half is equal to the distance between the centers of the rims surrounding the inlet and outlet openings of the housing half.

3 Claims, 5 Drawing Figures

MULTISTAGE SIDE CHANNEL COMPRESSOR

BACKGROUND OF THE INVENTION

1. Field of the Invention

The invention relates to a side channel compressor wherein the compressor comprises first and second compressor stages each including first and second housing halves axially arranged in side by side relationship and wherein the inner adjacently arranged housing halves of each stage include at least one inlet or outlet opening for forming a passage for connecting the stages.

2. Description of the Prior Art

A multistage side channel compressor of the above type is disclosed in U.S. Pat. No. 3,545,890. As above indicated, the inner housing halves of the compressor stages are each provided with only one inlet or outlet opening. The outlet opening of the inner housing half of one of the compressor stages, in turn, is connected to the inlet opening of the inner housing half of the other compressor stage via a passage opening provided in an intermediate element arranged between the two stages. In this manner, the two compressor stages are connected in series and the compressor is thereby capable of producing about twice the pressure at about the same output. If, on the other hand, a larger output at a lower pressure rather than at a higher pressure is required, the individual compressor stages have to be connected in parallel. Such a parallel connection, however, is not possible in the above described known side channel compressor.

Another type of a side channel compressor is also known in which separate deflecting devices are mounted at the inlet and outlet openings of the individual compressor stages, for deflecting the flow so as to effect parallel or series connection of the individual stages. For modifying compressors which do not have the latter capability, the appropriate deflection devices must be bought and mounted as separate components.

It is an object of the present invention to provide a side channel compressor having first and second compressor stages designed to permit series or parallel connection thereof as desired.

SUMMARY OF THE INVENTION

In accordance with the principles of the present invention, the above and other objectives are accomplished in a compressor of the above type by providing each inner housing half with inlet and outlet openings of the same shape and size and with sealing rims each in surrounding relationship with one of the inlet and outlet openings. Each inner housing half is further provided with an additional sealing rim, where the additional sealing rim in the inner housing half of the first compressor stage is arranged circumferentially ahead of the outlet opening of that stage, and the additional sealing rim in the inner housing half of the second compressor stage is arranged circumferentially behind the inlet opening of that housing half. Each additional rim is further arranged so that the distance between its center and the center of the sealing rim of the adjacent inlet or outlet opening of its respective housing half is equal to the distance between the centers of the sealing rims surrounding the inlet and outlet openings of that housing half.

With the inner housing halves provided with such additional rims the first and second compressor stages can be shifted in the circumferential direction relative to each other. Thus, for parallel connection of the stages, the inlet openings of both inner housing halves are made to coincide as are the outlet openings of both housing halves. For series connection, however, the compressor stages are shifted relative to each other such that the outlet opening of one inner housing half coincides with the inlet opening of the other inner housing half, and the remaining inlet opening of the one half and outlet opening of the other half are covered by the additional sealing rims provided in the housing halves.

In the embodiment of the invention to be disclosed hereinafter, the housing halves of each stage are further provided with connecting points uniformly distributed over their circumferences. In this embodiment, the sealing rims surrounding the inlet and outlet openings of each compressor stage are arranged so that the angle included between axes running from the centers of the rims to the center of the stage is equal to or a multiple of the angle included between axes running from two adjacent connecting points to the stage center. In a further aspect of the invention, the inner housing half of the first stage is provided with yet an additional sealing rim arranged circumferentially behind the inlet opening of that stage and the inner housing half of the second stage with still a further sealing rim arranged circumferentially ahead of the outlet opening of that stage. This permits shifting of the inner housing halves relative to one another in either direction.

BRIEF DESCRIPTION OF THE DRAWING

The above and other features and aspects of the present invention will become more apparent upon reading the following detailed description in conjunction with the attached drawings, in which.

DETAILED DESCRIPTION

Figure 1:
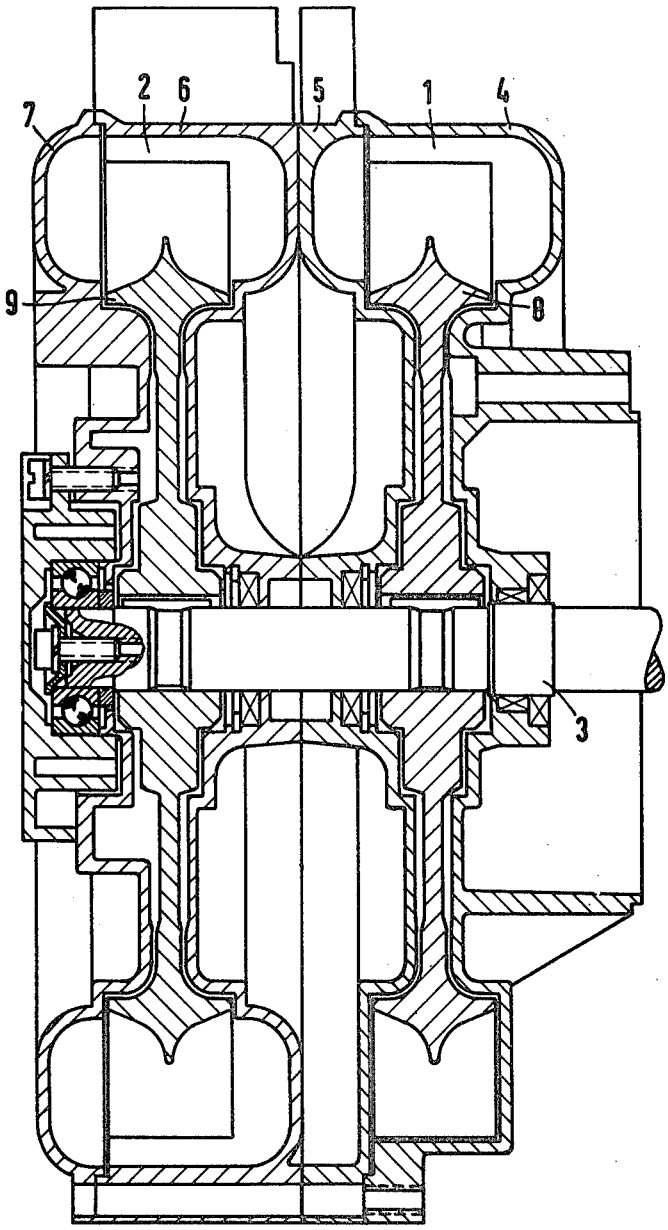
FIG. 1 shows a side channel in accordance with the principles of the present invention.

FIG. 1 shows a side channel compressor comprised of first and second compressor stages 1 and 2 arranged on a common shaft 3. The compressor stage 1 includes an outer housing half 4 and an inner housing half 5. Similarly, the compressor stage 2 includes an inner housing half 6 and an outer housing half 7. Supported within the housings of the stages 1 and 2 are impellers 8 and 9, respectively.

Figure 2:
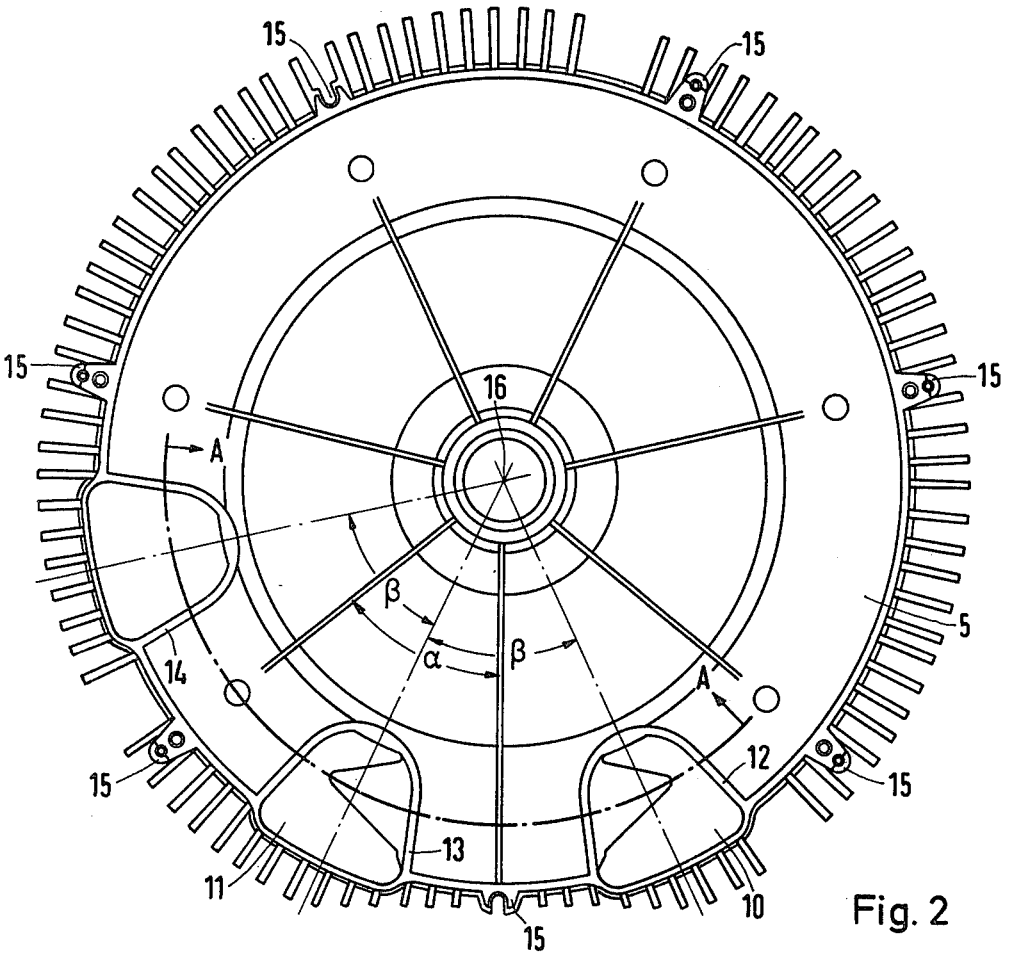
FIG. 2 illustrates a top view of an inner housing half of one of the stages of the compressor of FIG. 1.

As can be seen in FIG. 2, the inner housing half 5 is provided with an inlet opening 10 and an outlet opening 11. The openings 10 and 11 are surrounded by sealing rims 12 and 13, respectively. The housing half 5 is also provided with a further sealing rim 14 arranged ahead of the outlet opening 11 and whose center is at a distance from the sealing rim 13 which is equal to the distance between the centers of the sealing rims 12 and 13. Several connecting points 15 are also arranged around the circumference of the inner housing half 5; these points being spaced at a uniform distance from each other. As can be seen, each adjacent pair of connecting points 15 form an an angle $\alpha$ with the center 16 of the housing. Similarly, the axes through the housing center 16 and the centers of each two adjacent sealing rims 12 and 13 or 13 and 14 form an angle $\beta$. As shown, the angles $\alpha$ and $\beta$ are equal.

Figure 3:
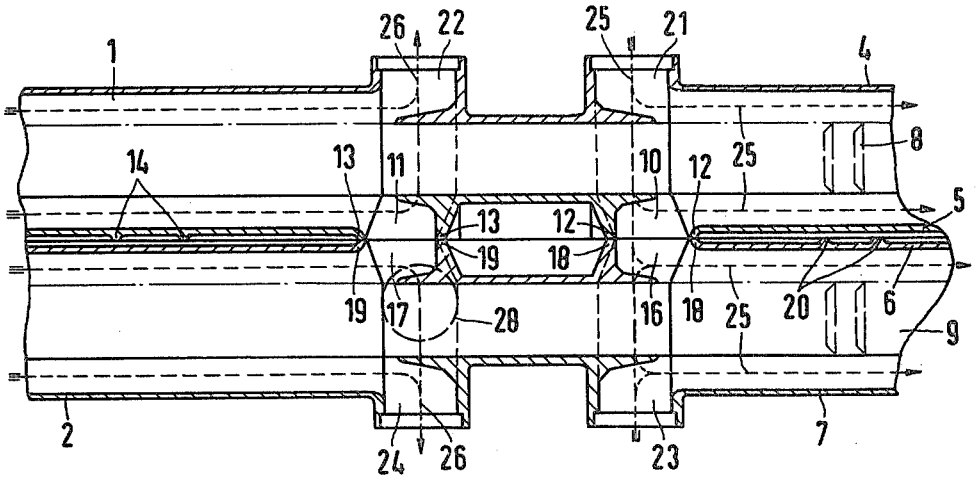
FIG. 3 shows a cross section taken along the circular arc A—A of FIG. 2, with the two compressor stages connected in parallel.

As shown in FIG. 3, the inner housing half 6 of the compressor stage 2 also is provided with inlet and outlet openings 16 and 17 and also with sealing rims 18 and 19, respectively, surrounding these openings. The inner housing half 6 furthermore is also provided with a further sealing rim 20 which, in this case, is arranged behind the inlet opening 16.

Figure 4:
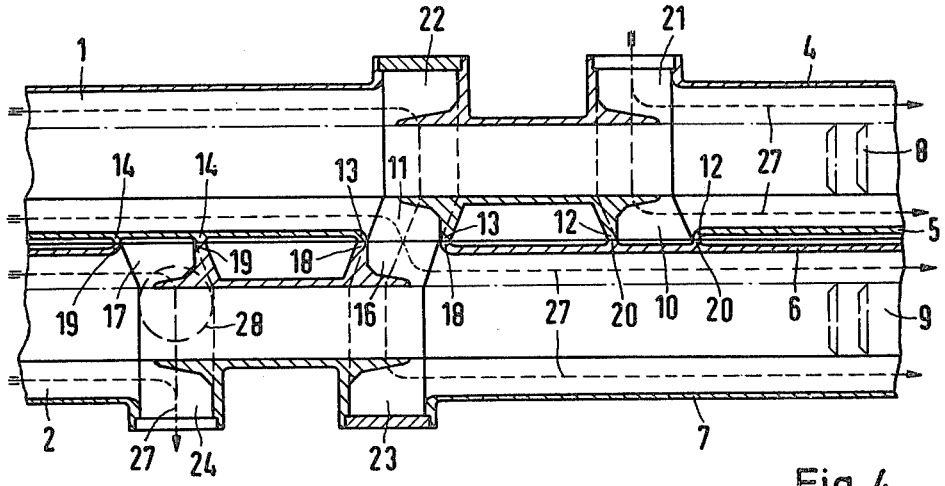
FIG. 4 illustrates the same view as FIG. 3 with the two compressor stages connected in series.

Inlet and outlet openings 21 and 22, respectively, are formed in the outer housing half 4 of the stage 1, while similar inlet and outlet openings 23 and 24 are formed in the outer housing half 7 of the compressor stage 2. In FIGS 3 and 4 arrow lines 25 indicate the entrance path and arrow lines 26 the exit path of the medium to be transported by the compressor.

In FIG. 3, the housings of the compressor stages 1 and 2 are connected to each other so that the inlet opening 10 of the inner housing half 5 of the compressor stage 1 coincides with the inlet opening 16 of the inner housing half 6 of the compressor stage 2. Similarly, the outlet opening 11 of the inner housing half 5 coincides with the outlet opening 17 of the inner housing half 6. With this type of connection, the two compressor stages 1 and 2 are connected in parallel. Hence, as indicated by the arrow lines 25, the medium to be transported can enter the compressor stages through both the inlet opening 21 and the inlet opening 23. Alternatively, one of the inlet openings 21 and 23 can be covered up by a cover so that the medium to be transported then enters via only one opening and finds its way into the other compressor stage via the inlet openings 10 and 16 of the two inner housing halves 5 and 6. As indicated by arrow lines 26, the medium to be transported leaves the compressor stages via both the outlet openings 22 and 24. Here, again, in the alternative, the outlet opening of one of the compressor stages can be covered up or closed off. In such case, the medium to be transported then passes via the outlet openings 11 and 17 into the respective other compressor stage and leaves the side channel compressor via the outlet opening thereof. It should be noted that the inlet and outlet openings of the compressor stages may also be arranged in the compressor so as to extend radially as is indicated by the outlet opening 28 shown in FIGS. 3 and 4 in broken line.

In FIG. 4, the two compressor stages 1 and 2 have been shifted or rotated in the circumferential direction relative to each other so as to connect the compressors in series. In particular, the compressor stages 1 and 2 have been rotated relative to one another by the angle $\alpha$. As the angles $\alpha$ and $\beta$ are equal such rotation causes the outlet opening 11 of the inner housing half 5 to now coincide with the inlet opening 16 of the inner housing half 6. The inlet opening 10 of the inner housing half 5, on the other hand, is covered by the further sealing rim 20 of the inner housing half 6. Similarly, the outlet opening 17 of the inner housing half 6 is covered or closed off by the further sealing rim 14 of the inner housing half 5. Additionally, the outlet opening 22 of the outer housing half 4 and the inlet opening 23 of the outer housing half 7 have been closed off by means of covers.

As indicated by arrow lines 27, the medium to be transported enters the side channel compressor through the inlet opening 21 in the outer housing half 4. After one revolution of the compressor stage 1, the medium passes into the compressor stage 2 via the outlet opening 11 and the inlet opening 16 in the inner housing halves 5 and 6. After another revolution in the compressor stage 2, the medium leaves the side channel compressor via the outlet opening 24 in the outer housing half 7. The medium, therefore, traverses the two compressor stages 1 and 2 sequentially and is thus compressed to a higher pressure.

Figure 5:
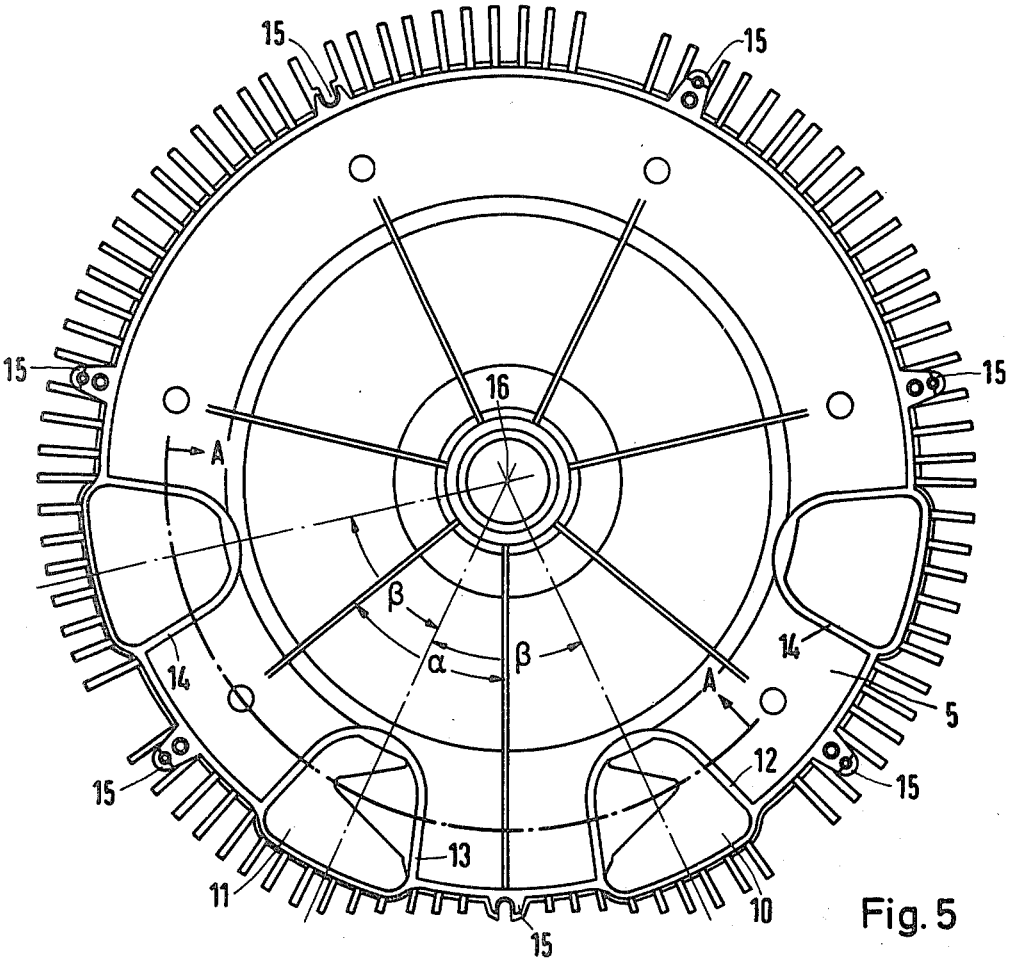
FIG. 5 is a top view of an alternative inner housing half to that of FIG. 2.

The first stage inner housing half illustrated in FIG. 5 has yet another sealing rim 14 arranged in the circumferential direction behind the inlet opening 10. This permits shifting of this housing half in either direction. A like modification of the inner housing half of the second stage with another sealing rim arranged ahead of the outlet opening of that stage will permit shifting of the inner housing halves relative to one another in either direction.

As can be appreciated, with the present invention, parallel or series connection of the compressor stages 1 and 2 is accomplished by appropriate rotational arrangement of the stages. Moreover, since formation of the inlet and outlet openings as well as the further sealing rims of the inner housing halves occurs at the same time, there is no additional cost to the formation of the compressor. Furthermore, since no additional mechanisms are required for chaning from one mode to the other mode of operation, such a change-over is possible at any time.

What is claimed is:

1. In a side channel compressor comprising first and second compressor stages each including first and second housing halves arranged axially in side by side relationship, the second housing half of said first compressor stage and the first housing half of said second compressor being inner adjacently arranged housing halves, each of said inner housing halves having at least one inlet and one outlet opening for forming passages between said compressor stages, the improvement comprising:

said inlet and outlet openings of said inner housing halves being of the same shape and size;

each of said inner housing halves including sealing rims each arranged in surrounding relationship to one of said inlet and outlet openings of that housing half;

said second housing half of said first compressor stage having a further sealing rim arranged in the circumferential direction ahead of the outlet opening of that housing half, the center-to-center distance between said further sealing rim of said second housing half and the sealing rim surrounding the outlet opening of that housing half being equal to the center-to-center distance between the sealing rims surrounding the outlet and inlet openings of that housing half;

and said first housing half of said second compressor stage having a further sealing rim arranged in the circumferential direction behind the inlet opening of that housing half, the center-to-center distance between said further sealing rim of said first housing half and the sealing rim surrounding the inlet opening of that housing half being equal to the center-to-center distance between the sealing rims surrounding the outlet and inlet openings of that housing half.

2. In a compressor in accordance with claim 1, the improvement further comprising:

each of said housing halves of said first and second compressor stages having connecting points uniformly distributed over its circumference;

the angle included between the axes going through the respective centers of the sealing rims surrounding the inlet and outlet openings of each stage and the center of the housing halves of that stage being one equal to and an integral multiple of the angle included between the axes going through the respective centers of adjacent connecting points of that stage and the center of the housing halves of that stage.

3. In a side channel compressor in accordance with claim 1, the improvement wherein:

said second housing half of said first compressor stage has an additional sealing rim arranged in the circumferential direction behind the inlet opening of that housing half;

and saif first housing half of said second compressor stage has an additional sealing rim arranged in the circumferential direction ahead of the outlet opening of that housing half.

* * * * *